US006773244B2

(12) United States Patent
Lee et al.

(10) Patent No.: US 6,773,244 B2
(45) Date of Patent: Aug. 10, 2004

(54) DISCHARGING PART STRUCTURE FOR COMPRESSOR

(75) Inventors: Jang-Woo Lee, Changwon (KR); Byung-Ha Ahn, Busan (KR); Jae-Sul Shim, Busan (KR); Young-Jong Kim, Gimhae (KR); Jong-Hun Ha, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/363,819

(22) PCT Filed: Nov. 28, 2002

(86) PCT No.: PCT/KR02/02234

§ 371 (c)(1),
(2), (4) Date: Mar. 7, 2003

(87) PCT Pub. No.: WO03/048576

PCT Pub. Date: Jun. 12, 2003

(65) Prior Publication Data

US 2004/0105772 A1 Jun. 3, 2004

(51) Int. Cl.[7] ..... F04C 18/356; F04C 29/02
(52) U.S. Cl. ..... 418/216; 418/219; 418/DIG. 1
(58) Field of Search ..... 418/216, 219, 418/DIG. 1

(56) References Cited

U.S. PATENT DOCUMENTS

| | | | | | |
|---|---|---|---|---|---|
| 3,652,191 | A | * | 3/1972 | King et al. | 418/125 |
| 3,994,638 | A | * | 11/1976 | Garland et al. | 418/216 |
| 4,093,408 | A | * | 6/1978 | Yamaguchi | 418/216 |
| 4,596,519 | A | * | 6/1986 | Tuckey | 418/133 |
| 5,310,326 | A | * | 5/1994 | Gui et al. | 418/76 |

FOREIGN PATENT DOCUMENTS

| | | | | |
|---|---|---|---|---|
| JP | 55-46037 | * | 3/1980 | 418/219 |

* cited by examiner

*Primary Examiner*—John J. Vrablik
(74) *Attorney, Agent, or Firm*—Fleshner & Kim, LLP

(57) ABSTRACT

A discharge part structure of a compressor is disclosed. In the compressor comprising a cylinder assembly having a suction flow path and a discharge flow path, a Z-plate in the cylinder assembly for dividing an inner space into a plurality of compression spaces and for making a fluid be sucked, compressed, and discharged by being rotated by a motor unit, and vanes contacted to both sides of the Z-plate for dividing the respective compression spaces into a suction region and a compression region by reciprocation, an oil filtering space or a buffering space having a predetermined volume is formed at an outer side of a discharge flow path of the cylinder assembly. According to this, oil mixed with a fluid can be efficiently separated when the fluid is discharged, and vibration noise can be minimized.

16 Claims, 15 Drawing Sheets

DISCHARGING PART STRUCTURE FOR COMPRESSOR

TECHNICAL FIELD

The present invention relates to a compressor having a Z-plate corresponding to a rotary compressor, and particularly, to a discharging part structure of a compressor, in which a fluid compressed in a cylinder is discharged outside the cylinder.

BACKGROUND ART

Generally, a compressor is a device for converting mechanical energy into compression energy of a compression fluid, and a refrigerating compressor is largely classified into a reciprocating compressor, a scroll compressor, a centrifugal compressor, and a rotary compressor by compression methods.

The present applicant has developed a compressor having a Z-plate with a novel concept, which can be classified into the rotary compressor (hereinafter, will be called as 'Z'-compressor), and filed an application for the invention to the Korean Industrial Patent Office (Application No. 10-1999-42381, Application date: Oct. 1, 1999), which has been disclosed in May 7, 2001 with a Patent Laid-open publication number 2001-35687.

FIGS. 1, 2A, 2B, and 3 illustrate a Z-compressor filed by the present applicant, wherein the Z-compressor includes a motor unit mounted at an inner side of a hermetic container 10 for generating a driving force, and a compression unit mounted at a bottom portion of the motor unit for receiving the driving force and compressing gas.

The motor unit includes a stator S fixed at an inner side of the hermetic container 10, and a rotator R rotatably engaged to an inner side of the stator S.

Also, the compression unit includes a cylinder assembly D having an inner space V and provided with a suction flow path f1 and a discharge flow path f2 connected to the inner space V to be fixed to the hermitic container 10, and a rotary axis 20 engaged to the motor unit by being inserted to a center of the inner space V of the cylinder assembly D.

The cylinder assembly D includes a cylinder 30 fixed to an inner circumference wall of the hermetic container 10 by being provided with a through hole 31 of a cylindrical shape therein, and upper and lower bearings 40 and 50 respectively engaged to upper and lower portions of the cylinder 30 to form the inner space V with the cylinder 30 and having the rotary axis 20 penetrating therein.

The suction flow path f1 of the cylinder assembly D is composed of a suction hole formed to be connected to the through hole 31 at an outer circumference of the cylinder 30. Also, the discharge flow path f2 of the cylinder assembly D includes an opening 32 penetrated as an axis direction so as to have a predetermined width and a depth at one side of the cylinder 30, and first and second discharge holes 33 and 34 respectively formed at a frontal wall of the opening 32 of the cylinder 30 to be connected to the through hole 31.

At this time, the first and second discharge holes 33 and 34 are respectively formed in parallel in an axial direction with a predetermined interval.

A Z-plate 60 is provided to divide the inner space V of the cylinder assembly D into first and second spaces V1 and V2. The Z-plate 60 is formed at the rotary axis 20 as a unit so as to be located at the inner space V of the cylinder assembly D. Also, vanes 70 elastically supported to be always contacted to both sides of the Z-plate 60 and moving for converting the first and second spaces V1 and V2 into a suction region and a compression region, respectively, are penetrated to the upper bearing 40 and the lower bearing 50 of the cylinder assembly D, respectively, and engaged thereto.

The vanes 70 are located at upper and lower portions of the Z-plate 60, that is, they have a same phase when the cylinder assembly D is seen at a horizontal view. At this time, the vanes 70 are respectively inserted to the vane slots 41 and 51 formed in the upper bearing 40 and the lower bearing 50 of the cylinder assembly D.

The Z-plate 60 is formed as a circular shape having a predetermined thickness, and when seen at a lateral side, the Z-plate is composed of an upper convex curved surface portion r1 having a convex side, a lower concave curved surface portion r2 having a concave side, and a connection curved surface portion r3 for connecting the r1 and r2. That is, the Z-plate 60 is a curved surface of a sine wave, wherein the convex curved surface portion r1 and the concave curved surface portion r2 are located with an angle of 180° each other.

Also, as shown in FIGS. 2A and 2B, an open/close means 80 is engaged to the cylinder assembly D for opening/closing the discharge flow path f2 and discharging gas compressed in the compression region of the first and second spaces V1 and V2. A suction pipe 90 is engaged to the suction flow path f1 of the cylinder assembly.

The open/close means 80 includes a first discharge valve 81 engaged to a frontal wall of the cylinder opening 32 of the cylinder assembly D by an engaging bolt B for opening/closing the first discharge hole 33, and a second discharge valve 82 engaged to a frontal wall of the cylinder opening 32 of the cylinder assembly D by an engaging bolt B for opening/closing the second discharge hole 34.

Oil is filled at a bottom surface of the hermetic container 10, an oil flow path 21 is formed at an inner side of the rotary axis 20, and an oil feeder (not shown) is mounted at an inner side of the oil flow path 21 of the rotary axis 20 (Refer to FIG. 1).

A reference numeral 100 denotes an elasticity supporting means, 110 denotes a muffler and 99 denotes a discharge pipe.

Operations of the conventional Z-compressor will be explained.

First, if a power is applied to drive the motor unit, the rotary axis 20 rotates by receiving a driving force of the motor unit and the Z-plate 60 of the rotary axis 20 rotates at the inner space V of the cylinder assembly D.

As shown in FIG. 4, if an end portion of the convex curved surface portion r1 of the Z-plate 60 is located at a position a1 of the vanes 70 corresponding to the first and second spaces V1 and V2, gas compressed in the first space V1 is discharged to the first discharge hole 33 by an operation of the first discharge valve 81. If the discharge is completed, suction of the gas into the suction region is completed, gas is sucked to the suction region from the second space V2, and gas compression starts at the compression region. At this time, the second discharge hole 34 is closed by the second discharge valve 82.

Subsequently, the Z-plate 60 rotates, as shown in FIG. 5, if an end portion of the concave curved surface portion r2 of the Z-plate 60 is located at the position a1 of the vanes 70 corresponding to the first and second spaces V1 and V2, gas is sucked to the suction region from the first space V1, and gas compression starts at the compression region under a state that the first discharge hole 33 is closed by the first discharge valve 81. Then, gas discharge to the second discharge hole 34 in the second space V2 by opening the second discharge valve 82 is completed and gas suction into the suction region is completed.

That is, whenever the Z-plate 60 rotates one time, gas is sucked, compressed, and discharged in the first and second spaces V1 and V2, which is repeated.

Also, refrigerant gas in high temperature and high pressure discharged through the first and second discharge holes 33 and 34 is exhausted through the cylinder opening 32 of the cylinder assembly D, passes inside of the hermetic container 10, and discharged at an outer side of the hermetic container 10.

As the rotary axis 20 rotates, the oil filled at a bottom surface of the hermetic container 10 is fed by an oil feeder engaged to the rotary axis 20, sucked through the oil flow path 21 of the rotary axis 20, and supplied to a component in which a sliding takes place. The oil supplied to the component returns to the hermetic container 10 again.

However, in the conventional Z-compressor, as the Z-plate 60 rotates, gas in high temperature and high pressure compressed in the first and second spaces V1 and V2 of the cylinder assembly, respectively, is discharged through the first and second discharge holes 33 and 34 alternately and repeatedly. During said process, oil supplied to the inner space V of the cylinder assembly is mixed with the refrigerant gas and discharged, and the refrigerant gas in high temperature and high pressure mixed with the oil circulates a refrigerating cycle through the discharge pipe 99. According to this, the oil discharged with the refrigerant gas is accumulated at an inner side of the refrigerating cycle, thereby lowering a refrigerating efficiency. Besides, since oil is deficient at the inner side of the hermetic container 10, a performance of the compressor is lowered.

Also, as shown in FIG. 6, the refrigerant gas in high temperature and high pressure discharged through the first and second discharge holes 33 and 34 collides to the hermetic container 10 facing the first and second discharge holes 33 and 34 and shakes the hermetic container 10, thereby generating vibration noise.

Also, as shown in FIG. 2B, the open/close means 80 for opening/closing the first and second discharge holes 33 and 34 is composed of the first discharge valve 81, the second discharge valve 82, and first and second engaging bolts B for fixing and engaging the first and second discharge valves 81 and 82 respectively, thereby having many components. According to this, fabricating processes are increased, so that a fabrication productivity is lowered and a fabrication cost is enhanced.

DISCLOSURE OF THE INVENTION

Therefore, it is an object of the present invention to provide a discharge part structure of a compressor which minimizes oil mixed to refrigerant gas and discharged through a discharge pipe when refrigerant gas in high temperature and high pressure compressed and discharged in the first and second spaces in the cylinder assembly is discharged through the discharge pipe as a Z-plate rotates by receiving a driving force of a motor unit.

It is another object of the present invention to provide a discharge part structure of a compressor which minimizes vibration noise when refrigerant gas in high temperature and high pressure compressed and discharged in the first and second spaces in the cylinder assembly is discharged through the discharge pipe as a Z-plate rotates by receiving a driving force of a motor unit.

It is another object of the present invention to provide a discharge part structure of a compressor which simplifies a construction of a discharge valve and its construction components.

To achieve these objects, there is provided a discharge part structure of a compressor comprising a hermetic container; a cylinder assembly fixed to an inner side of the hermetic container and having a suction flow path and a discharge flow path; a Z-plate in the cylinder assembly for dividing an inner space into a plurality of compression spaces and for making a fluid be sucked, compressed, and discharged by being rotated by a motor unit; and vanes contacted to both sides of the Z-plate for dividing the respective compression spaces into a suction region and a compression region by reciprocation, wherein an oil filtering space having a predetermined volume is formed at an outer side of the discharge flow path of the cylinder assembly, and a discharge hole is formed at a means for forming the oil filtering space so as to discharge a fluid which passed through the oil filtering space to an inner side of the hermetic container.

The oil filtering space is provided with an opening groove having a predetermined depth to be connected to the discharge flow path at one side of an outer circumference wall of the cylinder assembly, thereby having a predetermined volume with an inner circumference surface of the hermetic container.

The opening groove of the oil filtering space is covered with a cover member.

The discharge flow path is formed with first and second discharge holes connected to the oil filtering space from respective compression spaces. Also, a means for opening/closing the first and second discharge holes includes a valve body portion fixed at a lateral side of the cylinder assembly by one engaging bolt, and first and second open/close arm portions extended from the valve body portion respectively for opening/closing the first and second discharge holes.

To achieve these objects, there is provided a discharge part structure of a compressor comprising a cylinder assembly having a suction flow path and a discharge flow path; a Z-plate in the cylinder assembly for dividing an inner space into a plurality of compression spaces and for making a fluid be sucked, compressed, and discharged by being rotated by a motor unit; and vanes contacted to both sides of the Z-plate for dividing the respective compression spaces into a suction region and a compression region by reciprocation, wherein a mounting recess is formed at an outer side of the cylinder assembly to be connected to the discharge flow path, a cover member is engaged to the mounting recess so as to form a buffering space connected to the discharge flow path, and a discharge hole for exhausting a fluid is formed to the cover member.

To achieve these objects, there is provided a discharge part structure of a compressor comprising a cylinder assembly having a suction flow path and a discharge flow path; and a Z-plate in the cylinder assembly for dividing an inner space into a plurality of compression spaces and for making a fluid be sucked, compressed, and discharged by being rotated by a motor unit, wherein the discharge flow path is formed with first and second discharge holes connected to an outer side of the cylinder assembly from the respective spaces, and a means for opening/closing the first and second discharge holes includes a valve body portion fixed at a lateral side of the cylinder assembly, and first and second open/close arm portions extended from the valve body portion respectively for opening/closing the first and second discharge holes.

MODES FOR CARRYING OUT THE PREFERRED EMBODIMENTS

Figure 1:
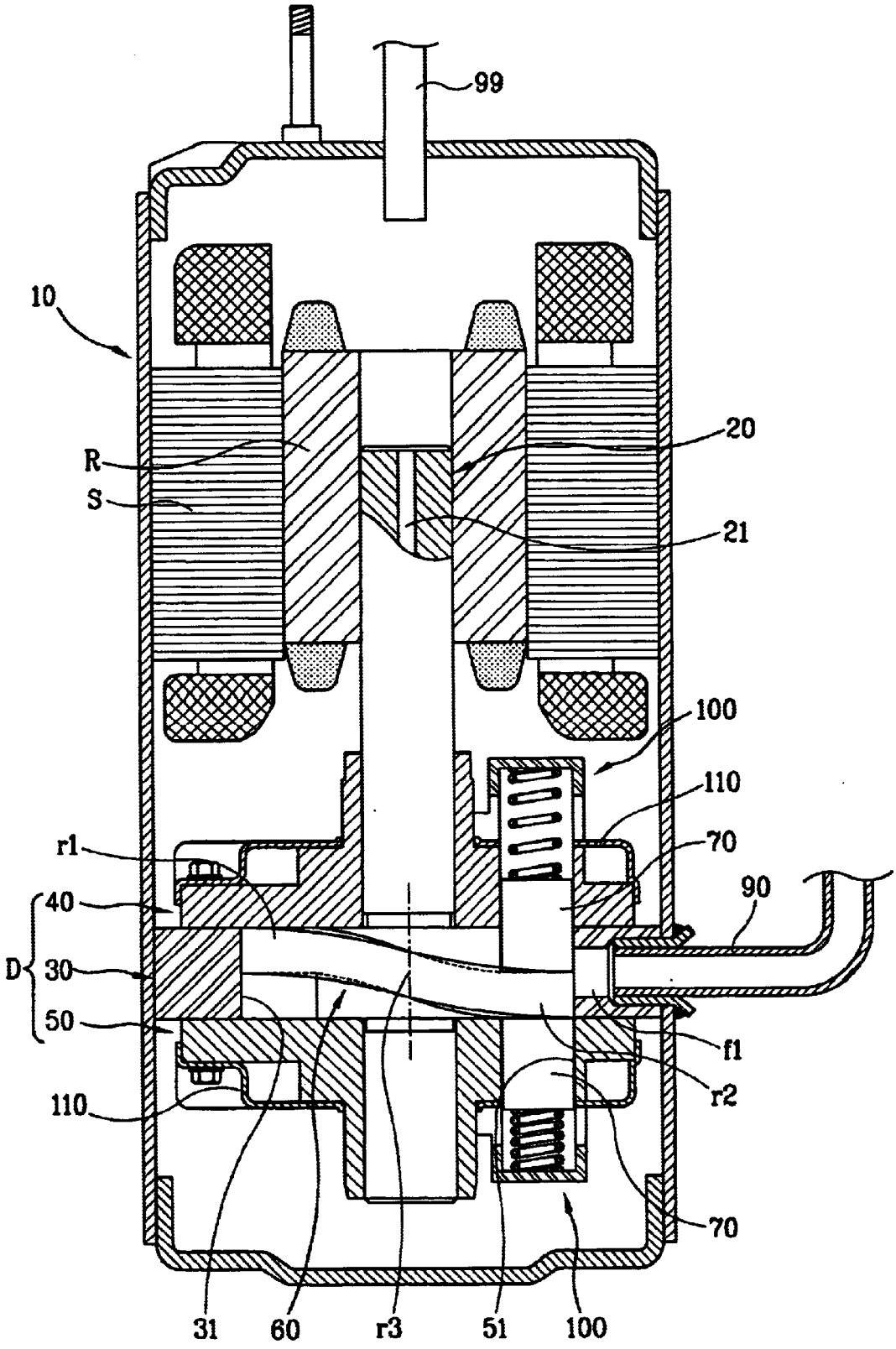
FIG. 1 PRIOR ART
FIG. 1 is a longitudinal sectional view showing a Z-compressor in accordance with the conventional art.
Figure 2A:
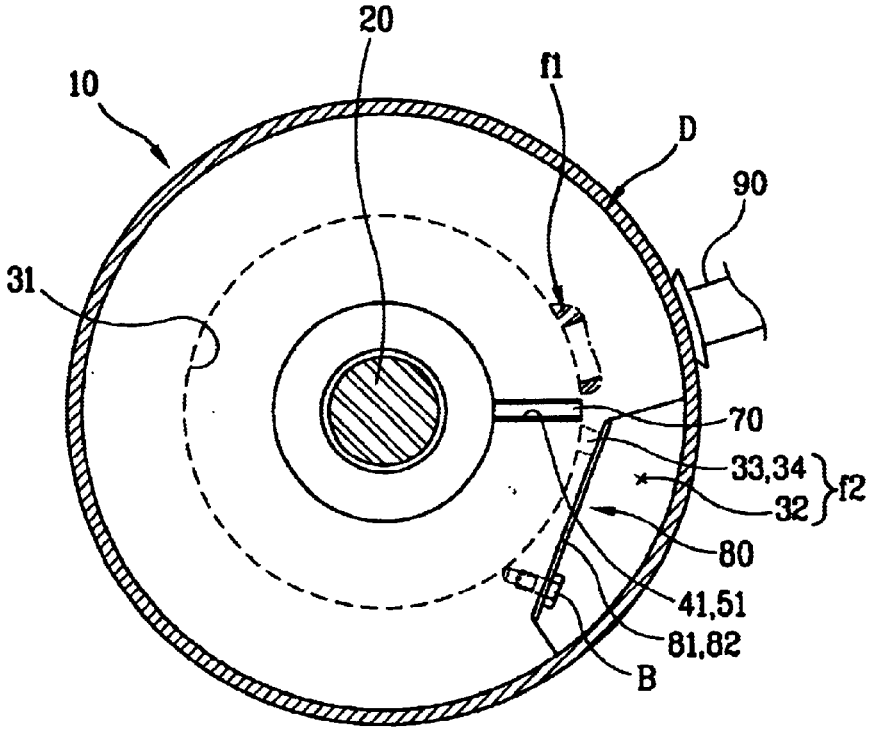
FIG. 2A PRIOR ART
FIG. 2A is a cross-sectional view showing a conventional Z-compressor.
Figure 2B:
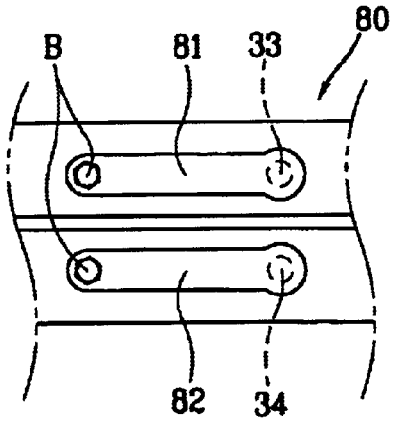
FIG. 2B PRIOR ART
FIG. 2B is a front view of a discharge valve.
Figure 3:
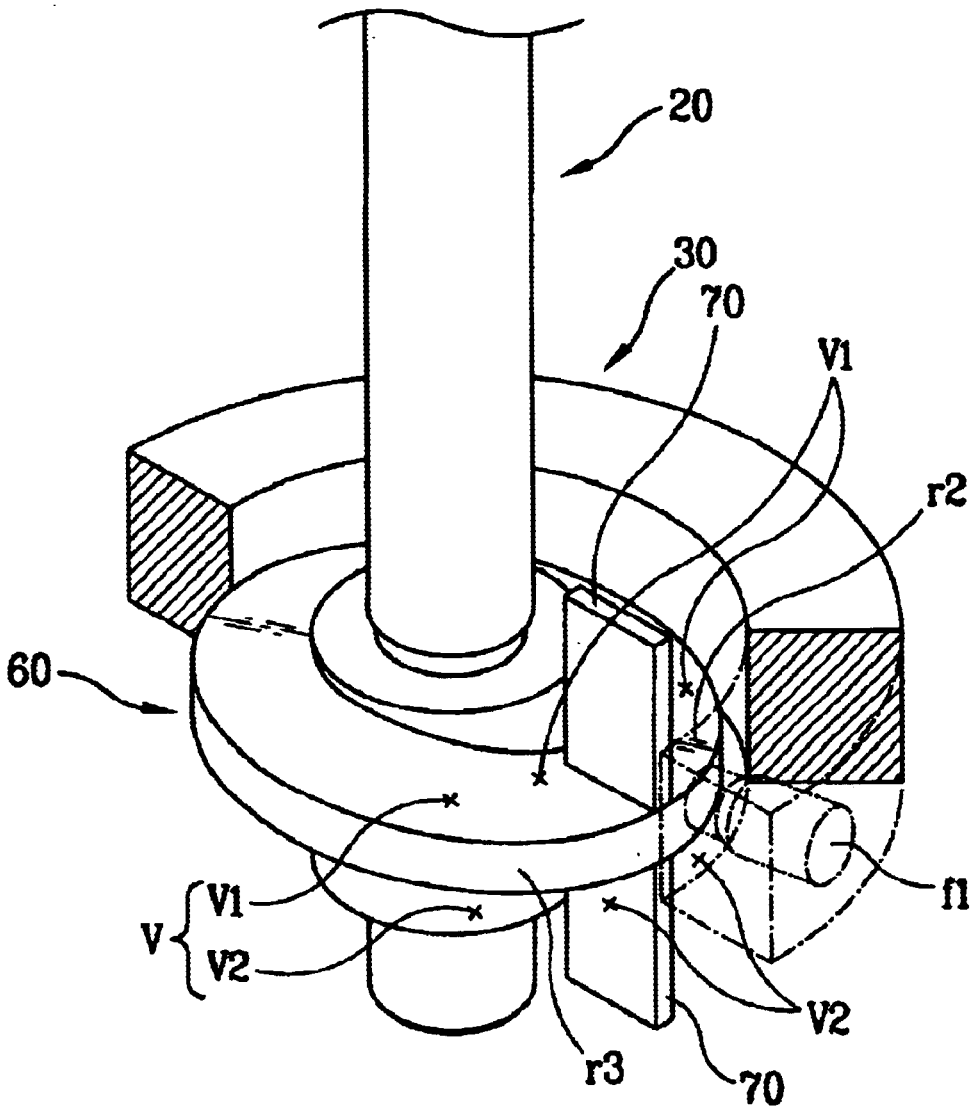
FIG. 3 PRIOR ART
FIG. 3 is a cut perspective view showing a compression unit of a conventional Z-compressor.
Figure 4:
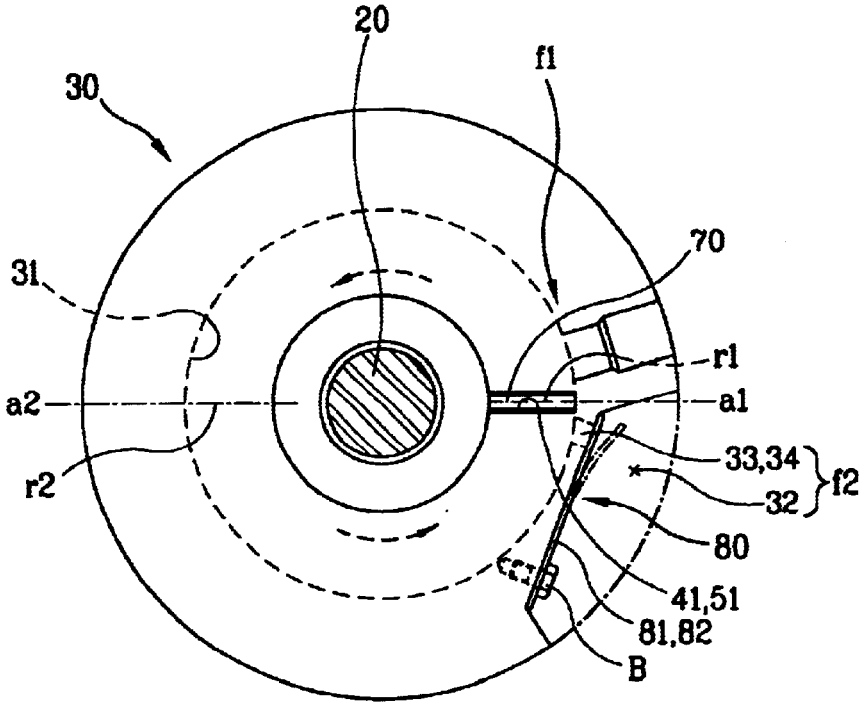
FIG. 4 PRIOR ART
FIGS. 4 and 5 are cross-sectional views respectively showing operation processes of the compression unit of a conventional Z-compressor.
Figure 5:
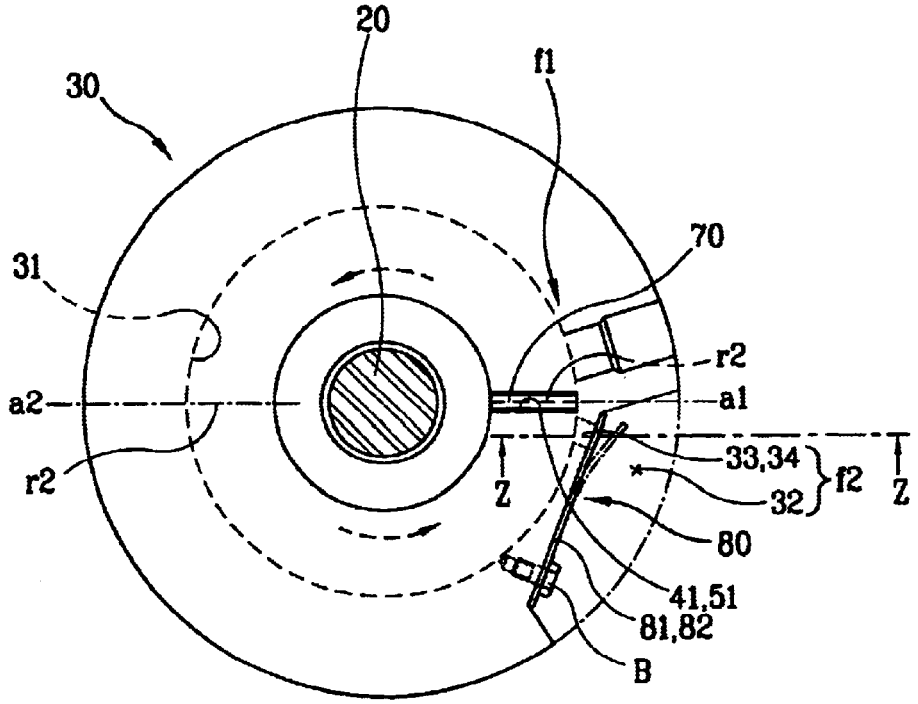
FIG. 5 PRIOR ART
Figure 6:
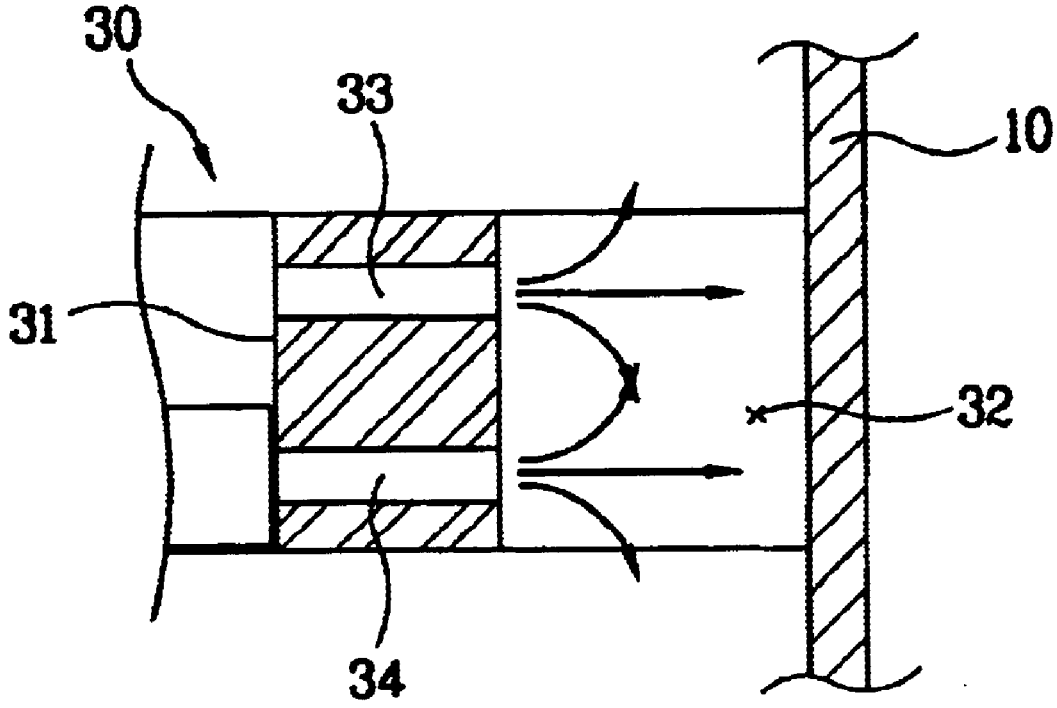
FIG. 6 PRIOR ART
FIG. 6 is a schematic sectional view taken along Z—Z line of FIG. 5.
Figure 7:
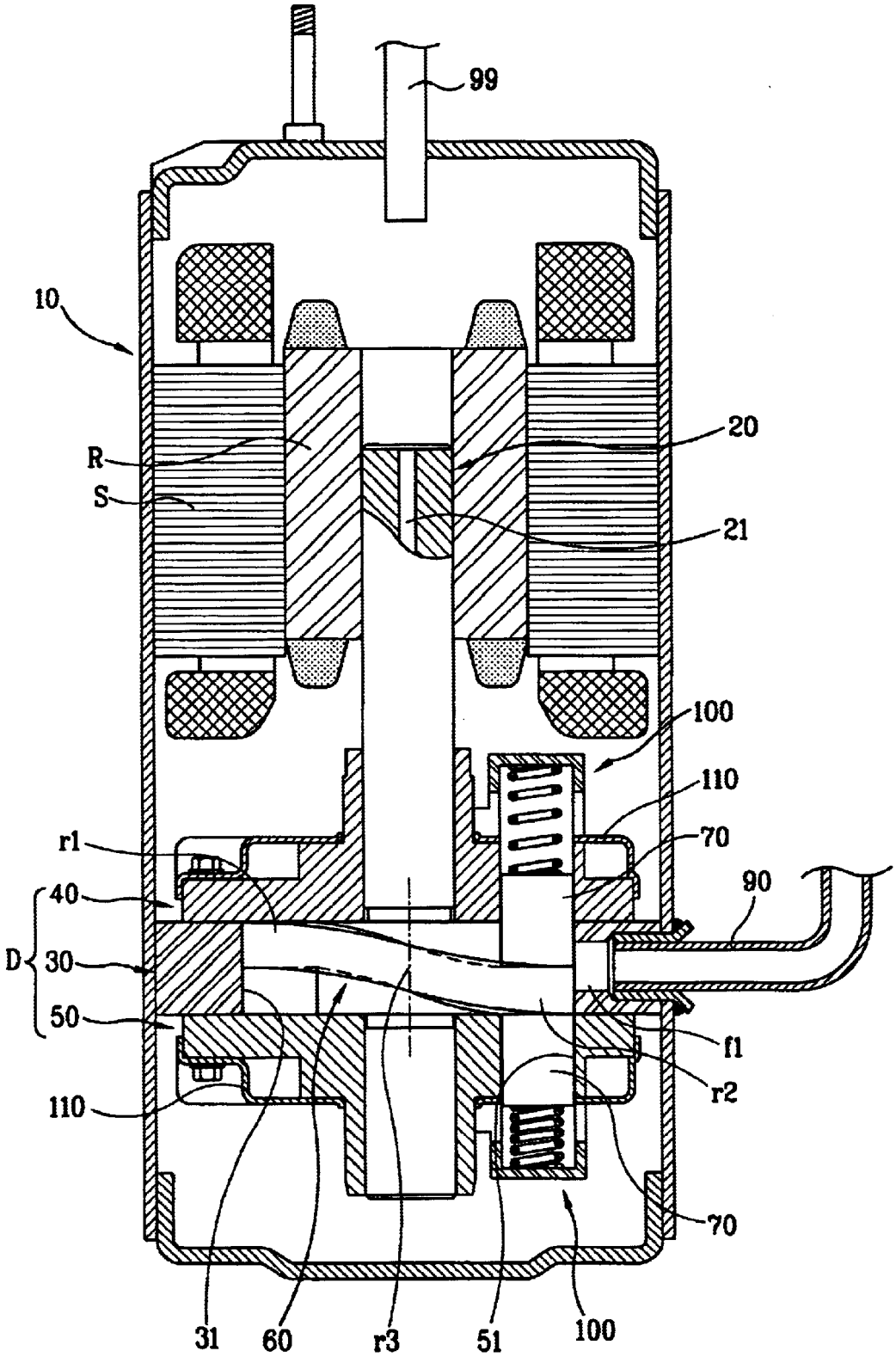
FIG. 7 is a longitudinal sectional view showing a Z-compressor having a discharge part structure according to the present invention.
Figure 8:
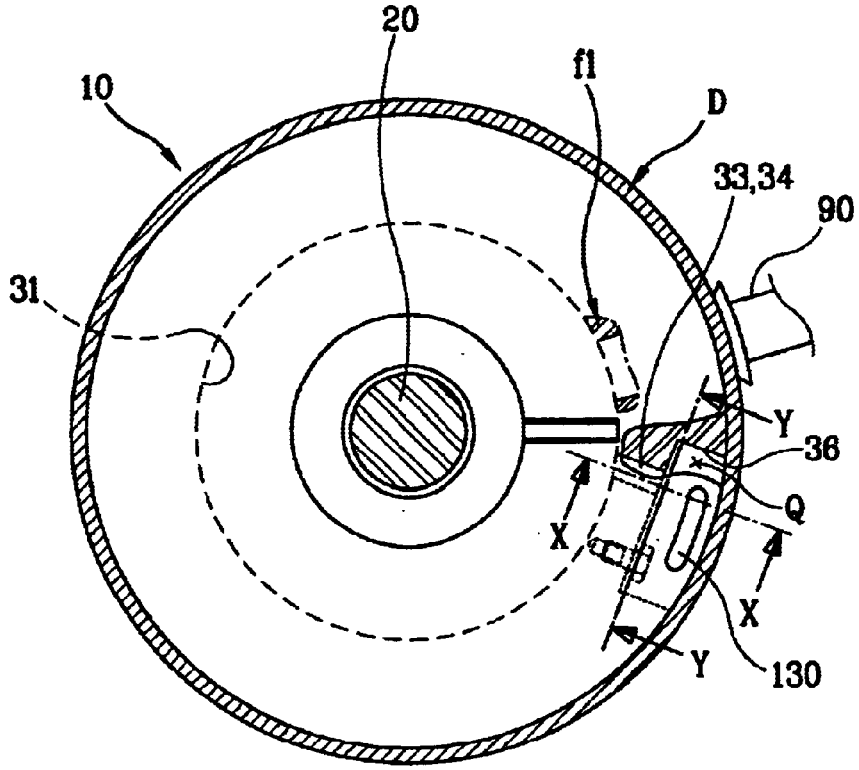
FIG. 8 is a cross-sectional view showing a Z-compressor having a discharge part structure according to an embodiment of the present invention.
Figure 9:
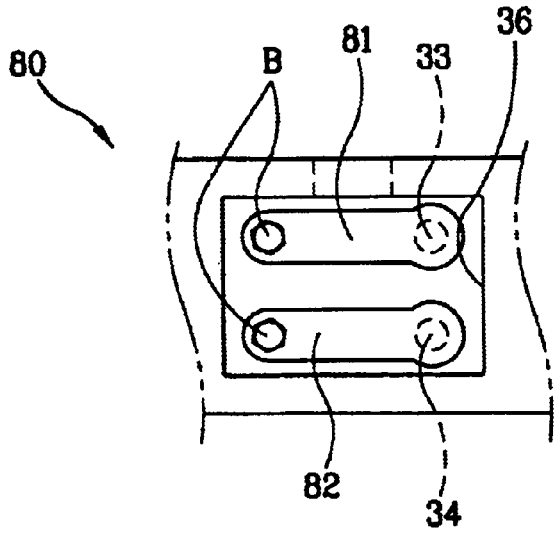
FIG. 9 is a view seen from Y—Y line of FIG. 8.
Figure 10:
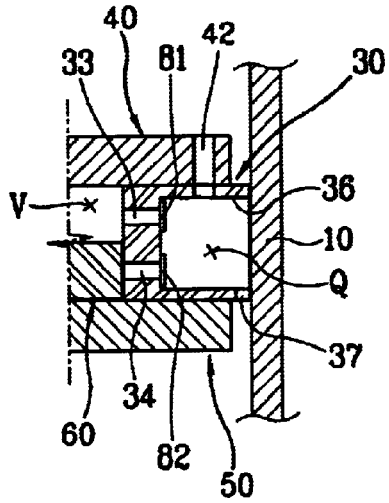
FIG. 10 is a view seen from X—X line of FIG. 8.
Figure 11:
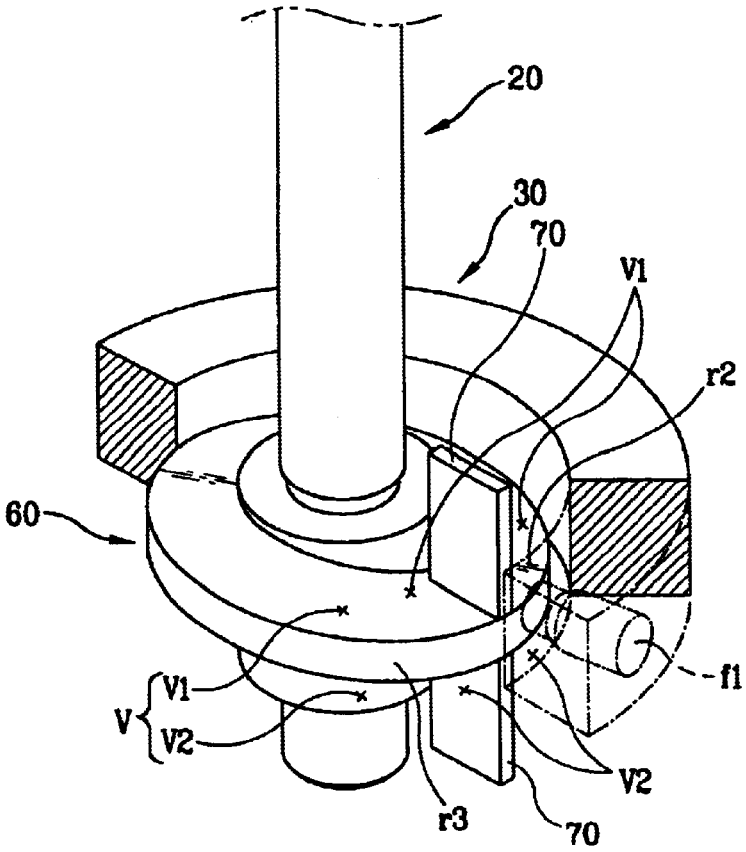
FIG. 11 is a partial cut perspective view showing a compression unit according to one embodiment of the present invention.

Hereinafter, preferred embodiments of a discharge part structure of a compressor according to the present invention will be explained with reference to attached drawings.

FIGS. 7 to 12 illustrate a Z-compressor according to one embodiment of the present invention, wherein the same constructions with those of the conventional art will be endowed the same reference numerals.

A Z-compressor according to the present invention includes a motor unit mounted at an inner side of a hermetic container 10 for generating a driving force and a compression unit mounted at a bottom portion of the motor unit for receiving the driving force and compressing gas.

The motor unit includes a stator S fixed at an inner side of the hermetic container 10, and a rotator R rotatably engaged to an inner side of the stator S.

Also, the compression unit includes a cylinder assembly having an inner space V and provided with a suction flow path f1 and a discharge flow path f2 connected to the inner space V to be fixed to the hermetic container 10, and a rotary axis 20 engaged to the motor unit by being inserted to a center of the inner space V of the cylinder assembly D.

The cylinder assembly D includes a cylinder 30 fixed to an inner circumference wall of the hermetic container 10 by being provided with a through hole 31 of a cylindrical shape therein, and upper and lower bearings 40 and 50 respectively engaged to upper and lower portions of the cylinder 30 to form the inner space V with the cylinder 30 and provided with the rotary axis 20 penetrating therein.

The suction flow path f1 of the cylinder assembly is composed of a suction hole formed to be connected to the through hole 31 at an outer circumference of the cylinder 30.

Also, the discharge flow path f2 of the cylinder assembly includes first and second discharge holes 33 and 34 for respectively connecting an inner circumference wall of the through hole and an outer wall of the cylinder at one side of the cylinder 30.

At this time, the first and second discharge holes 33 and 34 are respectively formed in parallel in an axial direction with a predetermined interval. Also, an opening groove 36 having a predetermined area and depth is formed at the outer circumference wall of the cylinder assembly 30 to be connected to the discharge flow path f2.

At this time, formed is an oil filtering space Q having a predetermined volume between the cylinder opening groove 36 of the cylinder assembly and an inner circumference surface of the hermetic container 10 contacted with the cylinder outer circumference wall of the cylinder assembly.

Also, a discharge hole 42 for discharging the gas which passed through the oil filtering space Q into the hermetic container 10 is formed at one side of the cylinder 30 of the cylinder assembly, and an oil exhausting hole 37 for exhausting oil filled at the oil filtering space Q is formed at the cylinder 30 of the cylinder assembly.

The discharge hole 42 of the cylinder assembly is preferably formed through one side of the cylinder 30 constituting the cylinder assembly D and the upper bearing 40 engaged to the cylinder 30. Also, the discharge hole 42 is formed towards the axis direction of the cylinder assembly D. The cylinder oil exhausting hole 37 is formed towards a lower surface of the hermetic container 10.

A Z-plate 60 for dividing the inner space of the cylinder assembly D into first and second spaces V1 and V2 is formed to the rotary axis 20 as a unit so as to locate the Z-plate 60 at the inner space V of the cylinder assembly. Also, vanes 70 which move for converting the first and second spaces V1 and V2 into a suction region and a compression region respectively as the Z-plate 60 rotates is elastically supported to always be contact to both sides of the Z-plate 60 and inserted to the upper and lower bearings 40 and 50 of the cylinder assembly D.

The vanes 70 are located at upper and lower portions of the Z-plate 60, that is, they have a same phase when the cylinder assembly D is seen at a horizontal view. Also, the vanes 70 are respectively inserted to vane slots 41 and 51 formed at the upper and lower bearings 40 and 50 of the cylinder assembly D.

The Z-plate 60 is formed as a circle shape having a predetermined thickness, and when seen at a lateral side, the Z-plate is composed of an upper convex curved surface portion r1 having a convex side, a lower concave curved surface portion r2 having a concave side, and a connection curved surface portion r3 for connecting the r1 and r2. That is, the Z-plate 60 is a curved surface of a sine wave, wherein the convex curved surface portion r1 and the concave curved surface portion r2 are located with an angle of 180° each other.

Also, an open/close means 80 is engaged to the cylinder assembly D for opening/closing the discharge flow path f2 and discharging gas compressed in the compression region of the first and second spaces V1 and V2. A suction pipe 90 is engaged to the suction flow path f1 of the cylinder assembly.

The open/close means 80 includes a first discharge valve 81 engaged to a frontal wall of the cylinder opening 36 of the cylinder assembly by an engaging bolt B for opening/closing the first discharge hole 33, and a second discharge valve 82 engaged to a frontal wall of the cylinder opening 36 of the cylinder assembly D by an engaging bolt B for opening/closing the second discharge hole 34.

Oil is filled at a bottom surface of the hermetic container 10, an oil flow path 21 is formed at an inner side of the rotary axis 20, and an oil feeder (not shown) is mounted at an inner side of the oil flow path 21 of the rotary axis 20.

A reference numeral 100 denotes an elasticity supporting means, 110 denotes a muffler and 99 denotes a discharge pipe.

Operations of the discharge part structure of the Z-compressor according to one embodiment of the present invention will be explained.

First, if a power is applied to drive the motor unit M, the rotary axis 20 rotates by receiving a driving force of the motor unit M and the Z-plate 60 of the rotary axis 20 rotates at the inner space V of the cylinder assembly D.

If an end portion of the convex curved surface portion r1 of the Z-plate 60 is located at a position of the vanes 70 corresponding to the first and second spaces V1 and V2, gas compressed in the first space V1 is discharged to the first discharge hole 33 by an operation of the first discharge valve 81. If the discharge is completed, suction of the gas into the suction region is completed, gas is sucked to the suction region from the second space V2, and gas compression starts at the compression region. At this time, the second discharge hole 34 is closed by the second discharge valve 82.

Subsequently, as the Z-plate 60 rotates, if an end portion of the concave curved surface portion r2 of the Z-plate 60 is located at the position of the vanes 70 corresponding to the first and second spaces V1 and V2, gas is sucked to the suction region from the first space V1, and gas compression starts at the compression region under a state that the first discharge hole 33 is closed by the first discharge valve 81. Then, gas discharge to the second discharge hole 34 in the second space V2 by opening the second discharge valve 82 is completed and gas suction into the suction region is completed.

That is, whenever the Z-plate 60 rotates one time, gas is respectively sucked, compressed, and discharged in the first and second spaces V1 and V2.

Figure 12:
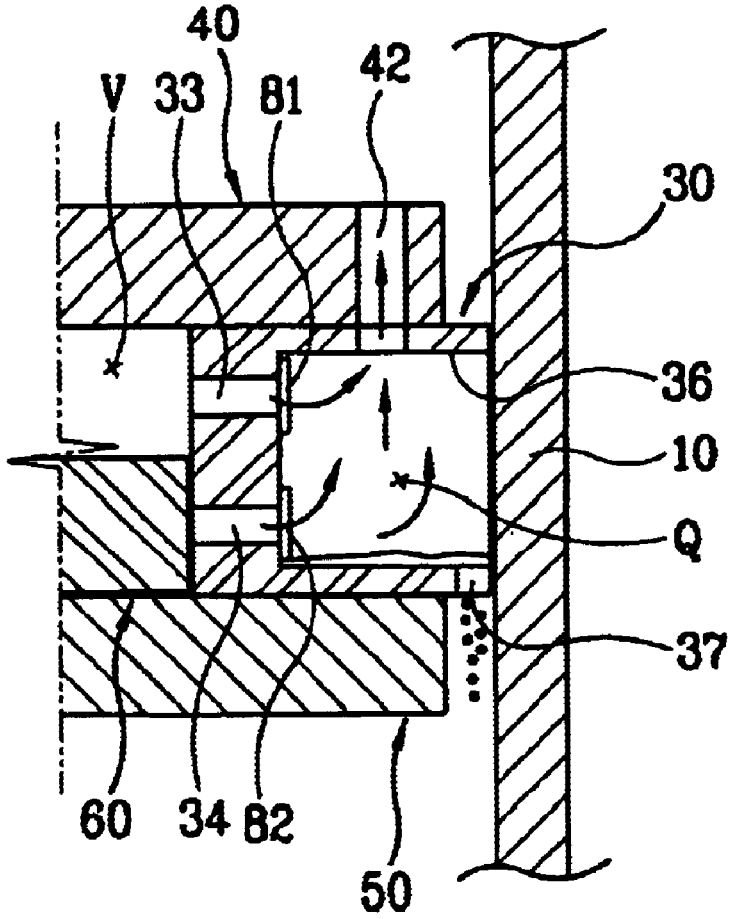
FIG. 12 is a sectional view showing a discharge operation state according to one embodiment of the present invention.

Also, as shown in FIG. 12, refrigerant gas in high temperature and high pressure discharged through the first and second discharge holes 33 and 34 is exhausted to an inner side of the hermetic container 10 via the cylinder opening 36 of the cylinder assembly D and the oil filtering space Q, the space Q formed by an inner circumference surface of the hermetic container 10 facing the cylinder opening 36. Then, the gas exhausted to the inner side of the hermetic container 10 is discharged at an outer side of the hermetic container 10 through the discharge pipe 99.

As the rotary axis 20 rotates, the oil filled at a bottom surface of the hermetic container 10 is fed by an oil feeder engaged to the rotary axis 20, sucked through the oil flow path 21 of the rotary axis 20, and supplied to a component in which a sliding takes place. The oil supplied to the component returns to the hermetic container 10 again.

In the meantime, gas in high temperature and high pressure compressed in the first and second spaces V1 and V2 of the cylinder assembly is mixed with oil supplied to the inner space V of the cylinder assembly and discharged with the oil. The oil discharged with the refrigerant gas collides to an inner wall of the oil filtering space Q, filtered, and filled at a bottom surface of the oil filtering space Q in a process of passing the oil filtering space Q. The oil filled at the oil filtering space Q returns to a bottom surface of the hermetic container 10 through the oil exhausting hole 37.

Accordingly, the refrigerant gas discharged to the discharge pipe 99 through the discharge hole 42 and the inside of the hermetic container 10 via the oil filtering space Q has the minimum amount of mixture with oil.

FIGS. 13A to 17 illustrate a Z-compressor having a discharge part structure of another embodiment according to the present invention, wherein the same parts with the construction of the aforementioned embodiment will be endowed with the same reference numerals and detailed explanations will be omitted.

Figure 13A:
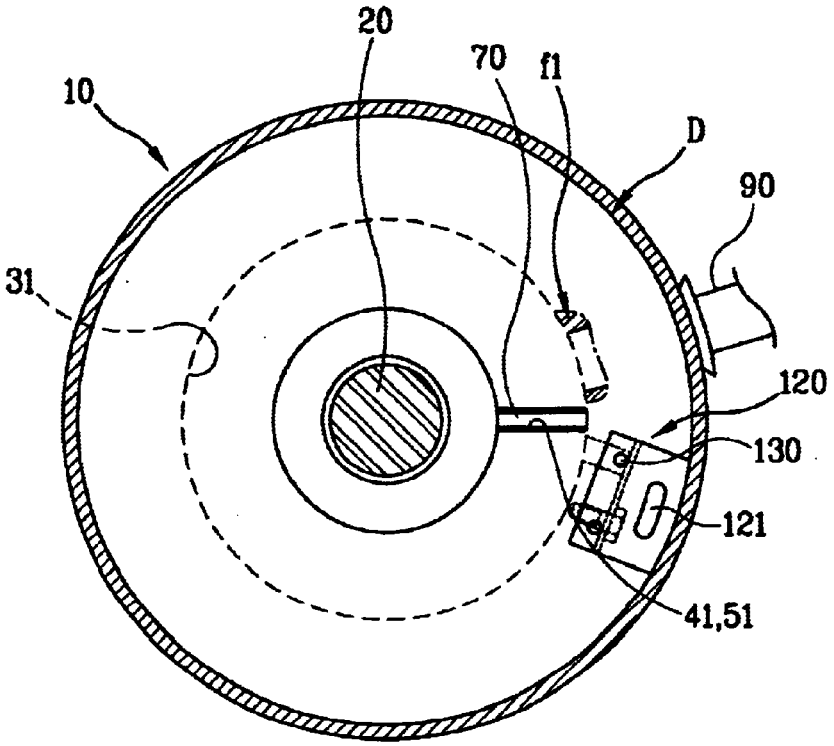
FIG. 13A is a cross-sectional view of a Z-compressor having a discharge part structure according to another embodiment of the present invention.
Figure 13B:
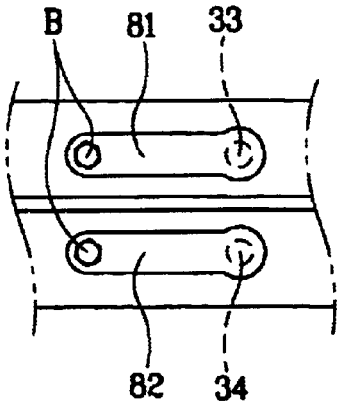
FIG. 13B is a front view of a discharge valve.
Figure 14:
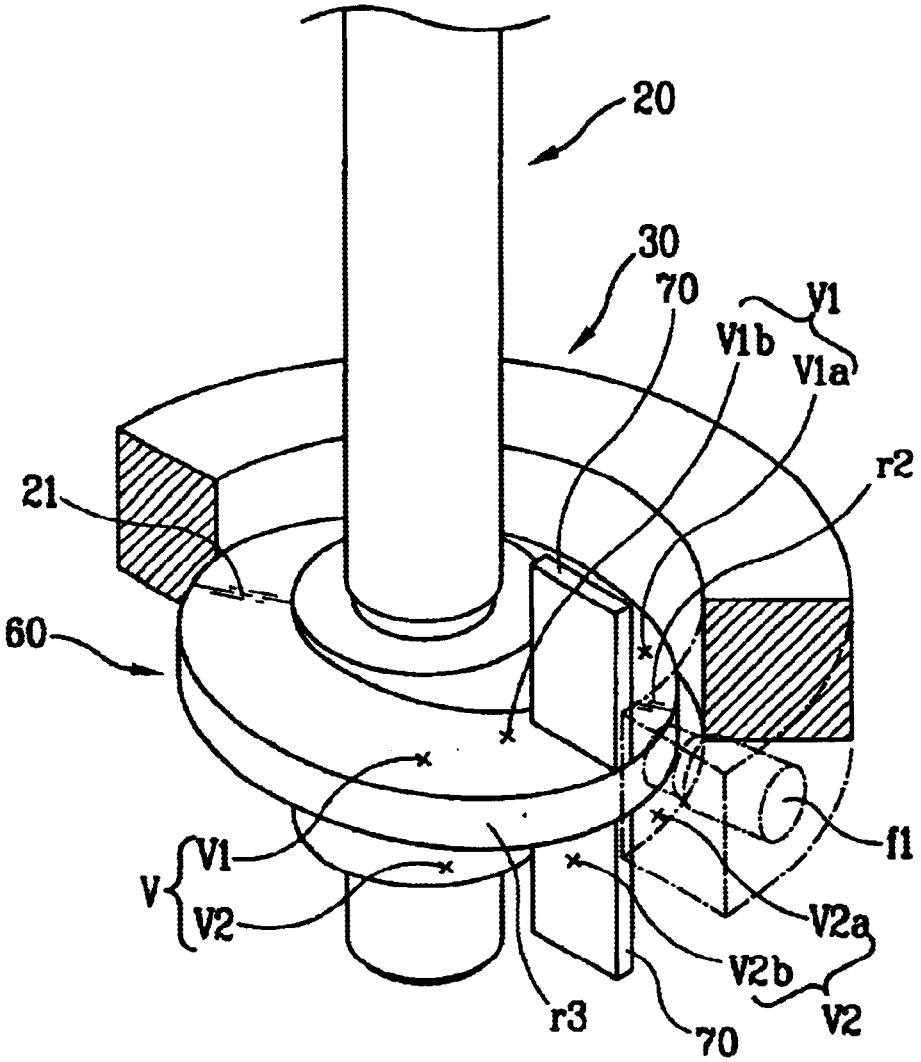
FIG. 14 is a partial cut perspective view showing a compression unit according to another embodiment of the present invention.

Referring to FIG. 13A, the suction flow path f1 of the cylinder assembly is composed of a suction hole formed to be connected to the through hole 31 at an outer circumference of the cylinder 30.

Also, the discharge flow path f2 of the cylinder assembly includes first and second discharge holes 33 and 34 formed to penetrate an inner circumference surface and an outer circumference surface of the cylinder 30. The first and second through holes 33 and 34 are formed on a same line towards upper and lower directions of the cylinder 30.

Figure 15:
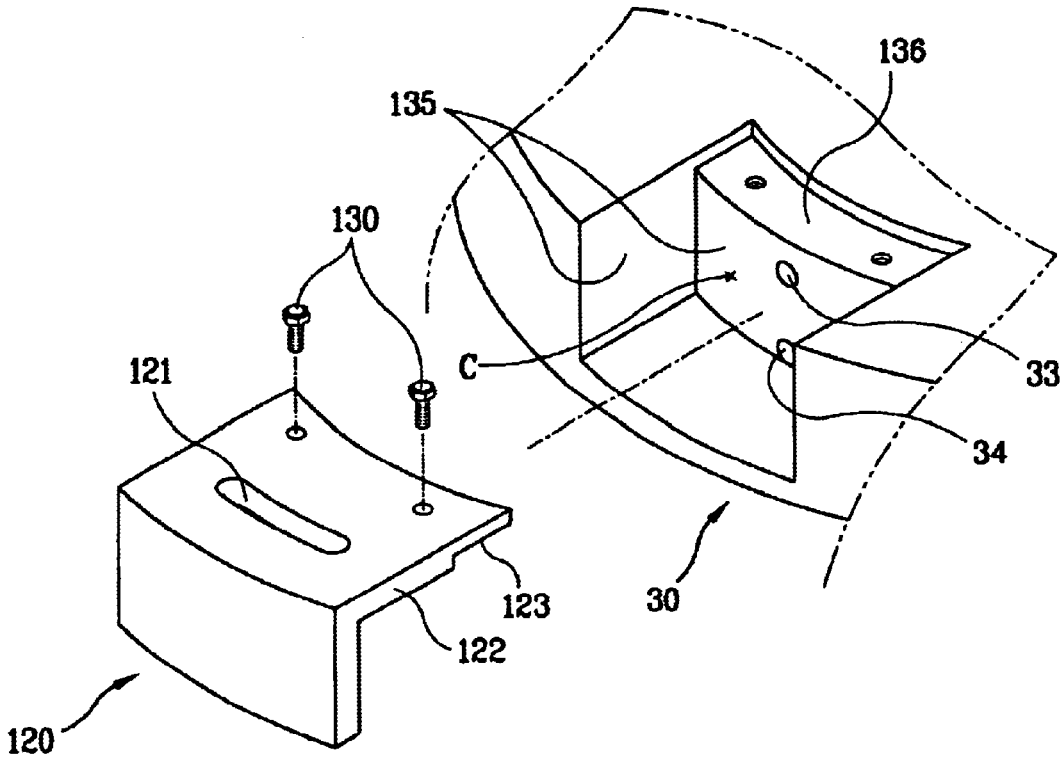
FIG. 15 is a disassembled perspective view showing a discharge part structure according to another embodiment of the present invention.

Also, as shown in FIG. 15, a mounting recess 135 is formed at one side of the cylinder 30 to be connected to the discharge flow path f2, a cover member 120 formed with a predetermined shape and having a discharge hole 121 at one side thereof is engaged to the mounting recess. At this time, formed is a buffering space C having a predetermined volume by an outer surface wall of the mounting recess 135 and an inner surface wall of the cover member 120. The buffering space C is connected to the discharge hole 121.

The mounting recess 135 of the cylinder assembly D is formed to have a predetermined width and a depth through the outer circumference surface of the cylinder 30 and one side surface, that is, a surface of a side to which the upper bearing 40 is engaged. The cover member 120 has the discharge hole 121 formed to penetrate therein at one side of the body lateral portion 122 of an 'L' shape having a width corresponding to that of the mounting recess 135 and a predetermined thickness.

In the cover member 120, a part where the discharge hole 121 is formed is located at a side where the upper bearing 40 is located, and the other side is located at an outer circumference surface of the cylinder 30. The part located at the outer circumference surface of the cylinder 30 is preferably located more inwardly than the outer circumference surface of the cylinder 30.

When the cover member 120 is engaged to the cylinder mounting recess 135 of the cylinder assembly D, a step portion 136 is provided at one side of the mounting recess 135 and a step portion 123 connected with the cylinder step portion 136 is provided at one side of the cover member 120. At this time, the step portion 123 of the cover member 120 is connected to the step portion 136 of the cylinder by a screw 130.

Figure 16:
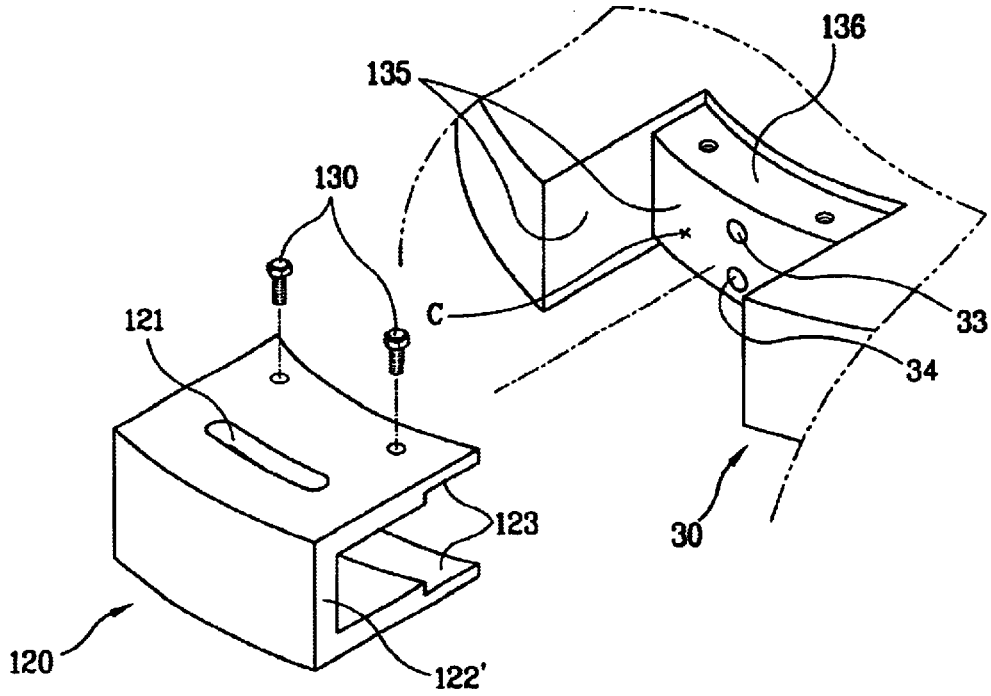
FIG. 16 is a disassembled perspective view showing a discharge part structure according to a variation of the another embodiment of the present invention.

As another modification example of the mounting recess 135 of the cylinder assembly D and the cover member 120 engaged to the mounting recess 135, as shown in FIG. 16, the mounting recess 135 of the cylinder assembly D is formed at one side of the cylinder 30 with a predetermined width in a longitudinal direction of the cylinder 30. Also, the cover member 120 is provided with the discharge hole 121 at one side between both sides of the body lateral portion 122' of 'U' shape having a width corresponding to that of the mounting recess 135.

A height of the cover member (as illustrated) is formed to correspond a thickness of the cylinder 30.

Also, an open/close means 80 for discharging gas compressed in the compression regions V1*b* and V2*b* of the first and second spaces V1 and V2 is engaged to the cylinder mounting recess 135 of the cylinder assembly D by respectively opening and closing the discharge flow path f2 of the cylinder assembly D, that is, that first and second discharge holes 33 and 34.

The open/close means 80 includes the first discharge valve 81 for opening and closing the first discharge hole 33, the engaging bolt B for engaging the first discharge valve 81, a second discharge valve 82 for opening and closing the second discharge hole 34, and the engaging bolt B for engaging the second discharge valve 82.

Figure 17:
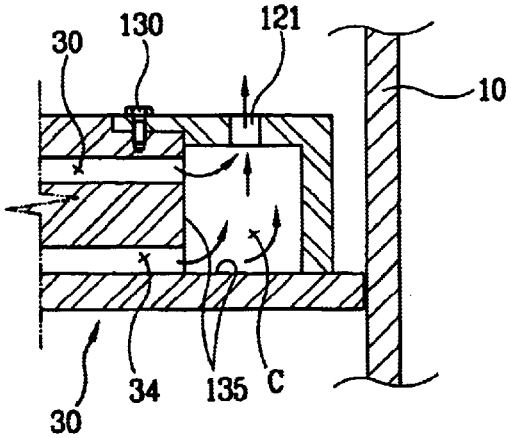
FIG. 17 is a sectional view showing an operation state of a discharge part structure according to another embodiment of the present invention.

In the Z-compressor having a discharge part structure of another embodiment according to the present invention, as the Z-pate 60 rotates one time, gas is sucked, compressed, and discharged respectively at the first and second spaces V1 and V2. As shown in FIG. 17, the refrigerant gas in high temperature and high pressure discharged through the first and second discharge holes 33 and 34 passes the buffering space C formed by the cylinder mounting recess 135 and the cover member 120 and is exhausted to an inner side of the hermetic container 10 through the discharge hole 121 formed at the cover member 120. Then, the gas is discharged to an outer side of the hermetic container 10 through a discharge pipe (not shown) engaged to the hermetic container 10.

Accordingly, since the refrigerant gas respectively compressed at the first and second spaces V1 and V2 of the cylinder assembly is discharged through the first and second discharge holes 33 and 34 and is exhausted to an inner side of the hermetic container 10 through the buffering space C formed by the cover member 120 and the cylinder mounting recess 135, the refrigerant gas in high temperature and high pressure discharged through the first and second discharge holes 33 and 34 does not directly collide to the hermetic container 10 to which the cylinder assembly 0 is engaged. Therefore, prevented is that the refrigerant gas in high temperature and high pressure collides to the hermetic container 10 and shakes the hermetic container 10.

In the meantime, the buffering space C formed by the cover member 120 and the cylinder mounting recess 135 also plays a role of the oil filtering space Q of the aforementioned embodiment according to the present invention.

Figure 18:
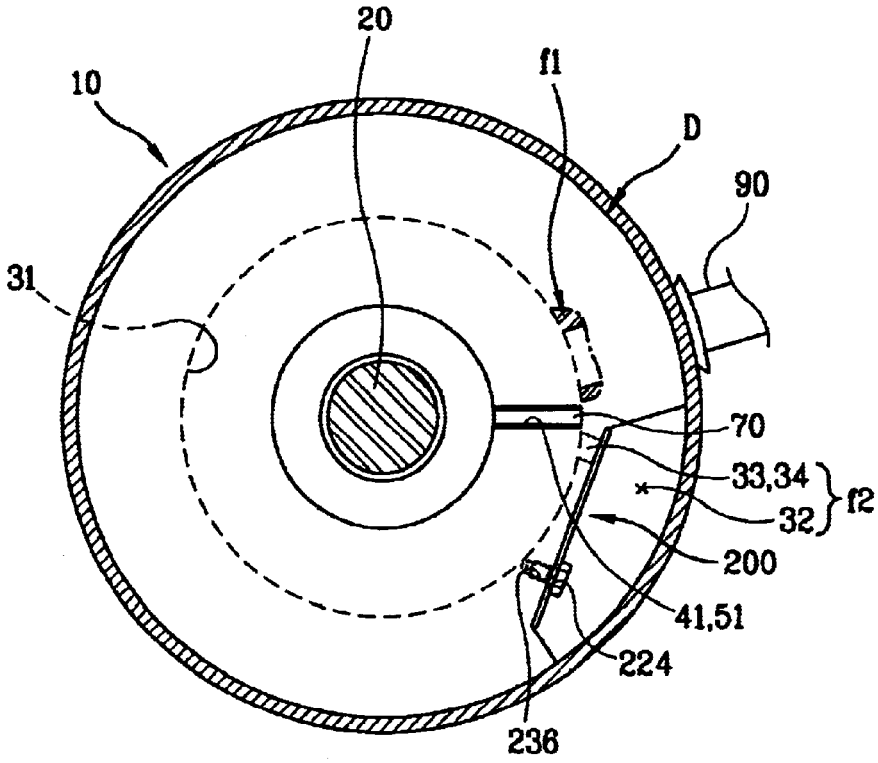
FIG. 18 is a cross-sectional view showing a Z-compressor having a discharge part structure according to another embodiment of the present invention.
Figure 19:
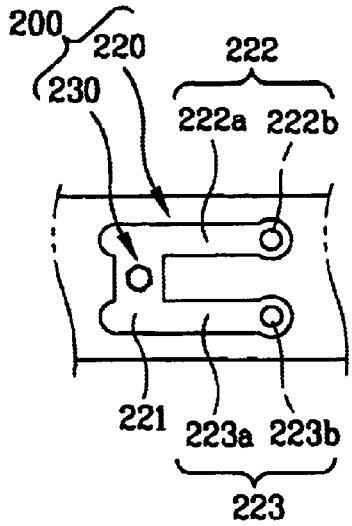
FIG. 19 is a front view showing a discharge valve of FIG. 18.
Figure 20:
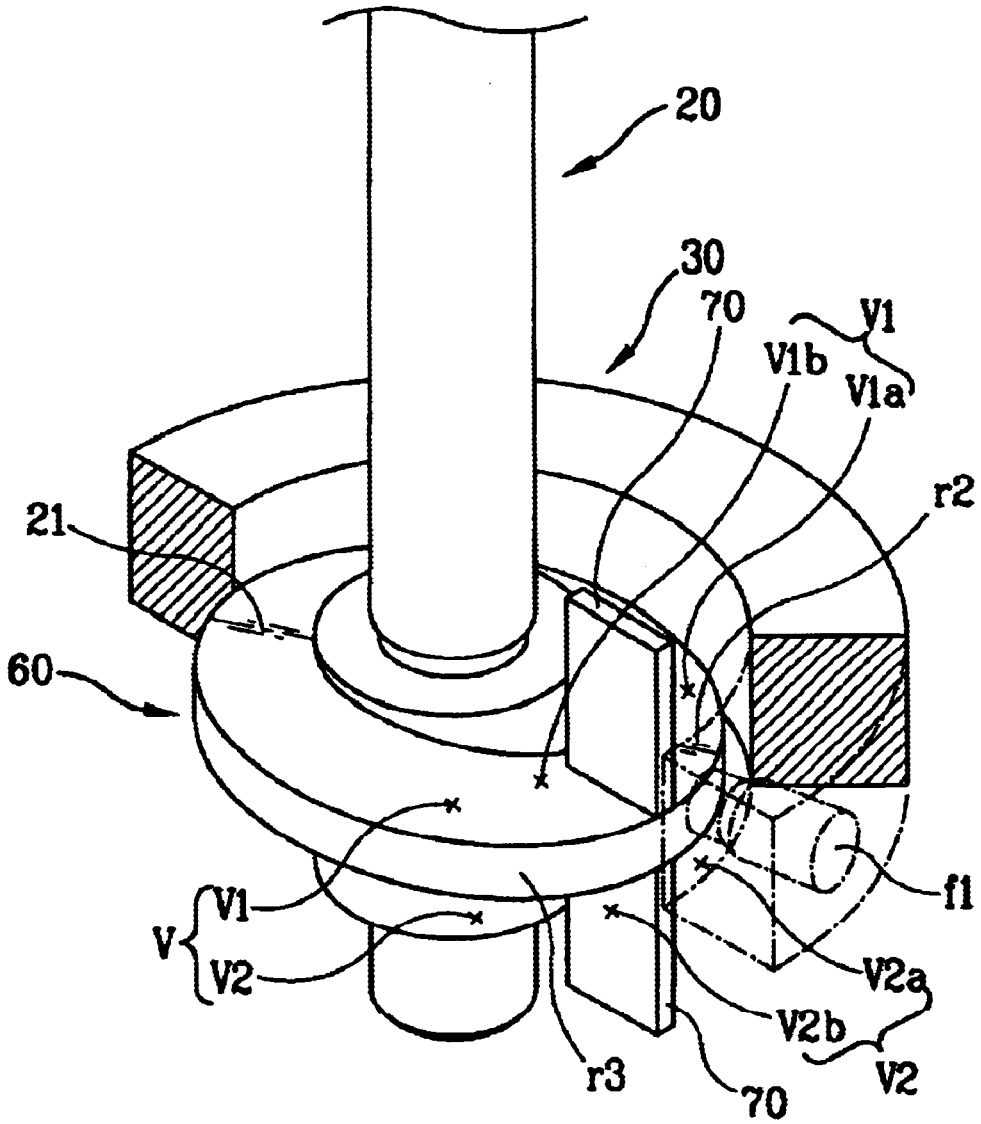
FIG. 20 is a partial cut perspective view showing a compression unit according to another embodiment of the present invention.

FIGS. 18 to 20 illustrate the Z-compressor having a discharge part structure of another embodiment according to the present invention, wherein the same parts with the construction of the aforementioned embodiment will be endowed the same reference numerals and detailed explanations will be omitted.

As shown in FIGS. 18, 19, and 20, an open/close means 200 for discharging gas compressed at the compression region V1*b* and V2*b* of the first and second spaces V1 and V2 is engaged to a front surface wall of the cylinder opening 32 of the cylinder assembly D by respectively opening and closing the discharge flow path f2 of the cylinder, assembly D, that is, the first and second discharge holes 33 and 34.

The open/close means 200 includes a multi open/close type discharge valve 220 having two open/close arms 222 and 223, and one engaging bolt 230 for engaging the open/close type discharge valve 220 to the cylinder assembly D.

The multi open/close type discharge valve 220 includes a valve body portion 221 having a predetermined shape of a thin plate and provided with a screw hole 224 therein, a first open/close arm portion 222 extended to have a predetermined area at one side of the valve body portion 221, and a second open/close arm portion 223 extended to have a predetermined area of a thin plate at one side of the valve body portion 221. The first and second open/close arm portions 222 and 223 are formed in parallel each other.

The first open/close arm portion 222 includes an arm 222*a* extended from the valve body portion 221 with a predetermined width and a length, and a circular shape portion 222*b* extended as a circular shape with an outer diameter larger than an inner diameter of the first discharge hole 33.

The second open/close arm portion 223 includes an arm 223*a* extended from the valve body portion 221 with a predetermined width and a length, and a circular shape portion 223*b* extended as a circular shape with an outer diameter larger than an inner diameter of the second discharge hole 34.

The front surface wall of the cylinder opening 32 of the cylinder assembly D is formed as a plane surface, and provided with a screw thread hole 236 at one side thereof. The screw thread hole 236 is located to a lateral portion of the first and second discharge holes 33 and 34.

When the multi open/close type discharge valve 220 is engaged to the front surface wall of the cylinder opening 32 of the cylinder assembly D, the screw hole 224 of the valve unit is unified to the screw thread hole 236, and the first and second open/close arm portions 222 and 223 are located to close the first and second open/close holes 33 and 34. At this time, the screw hole 224 of the valve body portion is engaged to the screw thread hole 236 by the engaging bolt 230.

Operations of another embodiment according to the present invention will be explained.

As the Z-plate 60 rotates at the inner space V of the cylinder assembly D, if an end portion of the convex curved surface portion r1 of the Z-plate 60 is located at a position of the vanes 70 corresponding to the first and second spaces V1 and V2, gas compressed in the first space V1 is discharged to the first discharge hole 33 by an operation of the first open/close arm portion 222. Then, if the discharge is completed, suction of the gas into the suction region V1*a* is completed, gas is sucked to the suction region V2*a* from the second space V2, and gas compression starts at the compression region V2*b*. At this time, the second discharge hole 34 is closed by the second open/close arm portion 223 of the multi open/close type discharge valve.

Subsequently, as the Z-plate 60 rotates, if an end portion of the concave curved surface portion r2 of the Z-plate 60 is located at the position of the vanes 70 corresponding to the first and second spaces V1 and V2, gas is sucked to the suction region V1*a* from the first space V1, and gas compression starts at the compression region V1*b* under a state that the first discharge hole 33 is closed by the first open/close arm portion 222 of the multi open/close type discharge valve. Then, gas discharge is completed as the second open/close arm portion 223 of the multi open/close type discharge valve opens the second discharge hole 34 in the second space. V2. Then, gas suction into the suction region V2*b* is completed.

That is, whenever the Z-plate 60 rotates one time, gas is sucked, compressed, and discharged in the first and second spaces V1 and V2, which is repeated to compress the gas.

Also, the multi open/close type discharge valve 220 open and close the first and second discharge holes 33 and 34 to discharge gas as the first and second open/close arm portions 222 and 223 are alternately bent and straightened by gas respectively compressed at the first and second spaces V1 and V2 of the inner space V of the cylinder assembly as the Z-plate 60 rotates.

Accordingly, since the discharge flow path, that is, the first and second discharge holes 33 and 34 for discharging gas compressed at the first and second spaces V1 and V2, is opened and closed by the multi open/close type discharge valve 220, and the multi open/close type discharge valve 220 is engaged by one engaging bolt 230, construction components are simple and a number of fabricating processes are reduced.

In the discharge part structure of the compressor according to the present invention, the refrigerant gas discharged at the first and second spaces of the cylinder assembly, passing an inner portion of the hermetic container, and exhausted through the discharge pipe is mixed with the minimum amount of oil to be discharged outside the hermetic container. According to this, an efficiency lowering of a cycle resulted from that oil is introduced to a refrigerating cycle including the compressor and accumulated is prevented, and oil deficiency in the hermetic container of the compressor is prevented to enhance a reliability.

Also, in the present invention, refrigerant gas in high temperature and high pressure compressed at the first and second spaces of the inner space of the cylinder assembly and discharge through the first and second discharge holes as the Z-plate rotates does not collide to the hermetic container but smoothly flows, thereby minimizing vibration noise at the time of discharging the refrigerant gas in high temperature and high pressure and then enhancing a reliability of the compressor.

Besides, in the present invention, since constructions for discharging gas compressed and the construction components are simplified and a number of a fabricating processes is reduced, a fabricating cost is reduced and a fabricating productivity is enhanced.

What is claimed is:

1. A discharge structure for a compressor, the compressor comprising a hermetic container, a cylinder assembly fixed to an inner side of the hermetic container and having a suction flow path configured to receive a fluid to be compressed and a discharge flow path configured to discharge the fluid from the compressor, a Z-plate configured to divide an inner space of the cylinder assembly into a plurality of compression spaces in which the fluid is compressed upon rotation of the Z-plate by a motor unit, and vanes positioned on both sides of the Z-plate for dividing the respective compression spaces into a suction region and a compression region, the discharge structure comprising:

a filtering chamber having a predetermined volume formed in communication with the discharge flow path of the cylinder assembly and configured to separate from the compressed fluid being discharged through the discharge flow path any lubricating fluid commingled with the compressed fluid, and a compressed fluid discharge hole formed in the filtering chamber and configured to discharge from the filtering chamber within the hermetic container the compressed fluid which has passed through the filtering chamber.

2. A compressor comprising the discharge structure of claim 1.

3. The discharge structure of a compressor of claim 1, wherein the filtering chamber comprises an open groove having a predetermined depth in communication with the discharge flow path at one side of an outer circumferential wall of the cylinder assembly, thereby facing and having a predetermined volume with respect to an inner circumferential surface of the hermetic container.

4. The discharge structure of claim 3, wherein the discharge hole is formed at one side of the cylinder assembly.

5. The discharge structure of claim 3, wherein the discharge hole is located in an axial direction of the cylinder assembly.

6. The discharge structure of claim 3, wherein the filtering chamber further comprises a lubricating fluid discharge hole configured to discharge lubricating fluid from the filtering chamber.

7. The discharge structure of claim 6, wherein the lubricating fluid discharge hole is formed at a side of the cylinder assembly opposite the compressed fluid discharge hole.

8. The discharge structure of claim 3, wherein the filtering chamber further comprises a cover member configured to cover the open groove.

9. The discharge structure of claim 8, wherein the compressed fluid discharge hole is formed in the cover member.

10. The discharge structure of claim 1, wherein the discharge flow path comprises first and second discharge holes connected to the filtering chamber from the respective compression spaces, and the discharge structure further comprises an opening/closing device configured to open/close the first and second discharge holes.

11. The discharge structure of claim 10, wherein the open/close device comprises a valve body portion fixed to a lateral side of the cylinder assembly by a connection device, and first and second open/close arm portions extended from the valve body portion, respectively, and configured to open/close the first and second discharge holes.

12. The discharge structure of claim 10, wherein the connection device comprises an engaging bolt.

13. A discharge structure of a compressor, the compressor comprising a cylinder assembly having a suction flow path configured to receive a fluid to be compressed and a discharge flow path configured to discharge the compressed fluid from the compressor, a Z-plate configured to divide an inner space of the cylinder assembly into a plurality of compression spaces in which the fluid is compressed upon rotation of the Z-plate by a motor unit, and vanes positioned on both sides of the Z-plate and configured to divide the discharge structure comprising;

a mounting recess formed in communication with the discharge flow path at an outer side of the cylinder assembly; and a cover member engaged to the mounting recess so as to form a buffering space in communication with the discharge flow path, wherein a discharge hole configured to discharge compressed fluid is formed in the cover member.

14. The discharge structure of claim 13, wherein the mounting recess has an open portion at an outer circumferential surface of the cylinder assembly, and the cover member comprises an 'L' shaped member engaged to the mounting recess.

15. The discharge structure of claim 13, wherein the mounting recess has two opened portions extending up and down at an outer circumferential surface of the cylinder assembly, and the cover member comprises a 'U' shaped member engaged to the mounting recess.

16. A compressor comprising the discharge structure of claim 13.

* * * * *